US010550671B2

(12) United States Patent
Stolboushkin

(10) Patent No.: US 10,550,671 B2
(45) Date of Patent: Feb. 4, 2020

(54) INFLOW CONTROL DEVICE AND SYSTEM HAVING INFLOW CONTROL DEVICE

(71) Applicant: Eugene Stolboushkin, Houston, TX (US)

(72) Inventor: Eugene Stolboushkin, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 51 days.

(21) Appl. No.: 15/838,921

(22) Filed: Dec. 12, 2017

(65) Prior Publication Data

US 2019/0178068 A1 Jun. 13, 2019

(51) Int. Cl.

| | |
|---|---|
| ***E21B 43/12*** | (2006.01) |
| ***E21B 43/24*** | (2006.01) |
| ***E21B 43/38*** | (2006.01) |
| ***E21B 43/30*** | (2006.01) |

(52) U.S. Cl.

CPC ..... *E21B 43/12* (2013.01); *E21B 43/128* (2013.01); *E21B 43/2406* (2013.01); *E21B 43/305* (2013.01); *E21B 43/38* (2013.01)

(58) Field of Classification Search

CPC ..... E21B 43/12; E21B 43/2406

See application file for complete search history.

(56) References Cited

U.S. PATENT DOCUMENTS

| | | | | |
|---|---|---|---|---|
| 5,305,209 | A | 4/1994 | Stein et al. | |
| 8,210,258 | B2 | 7/2012 | O'Malley et al. | |
| 8,469,105 | B2 | 6/2013 | O'Malley et al. | |
| 8,469,107 | B2 | 6/2013 | O'Malley | |
| 9,644,461 | B2 | 5/2017 | Castillo et al. | |
| 2005/0072567 | A1 | 4/2005 | Steele et al. | |
| 2010/0314103 | A1 | 12/2010 | Crossley et al. | |
| 2011/0139453 | A1* | 6/2011 | Schultz | E21B 43/12 166/272.3 |
| 2013/0048274 | A1* | 2/2013 | Schultz | E21B 28/00 166/244.1 |
| 2014/0166280 | A1 | 6/2014 | Stone et al. | |
| 2015/0047847 | A1 | 2/2015 | Mazyar et al. | |
| 2015/0159478 | A1 | 6/2015 | Georgi et al. | |
| 2015/0218922 | A1 | 8/2015 | Gano | |
| 2015/0247391 | A1 | 9/2015 | Oliva et al. | |

(Continued)

FOREIGN PATENT DOCUMENTS

| | | | |
|---|---|---|---|
| CA | 2902548 | A1 | 2/2017 |
| CA | 2940953 | A1 | 2/2017 |
| WO | WO2011098328 | A2 | 8/2011 |

OTHER PUBLICATIONS

Samson AG "Cavitation in Control Valves" Control Valves, 2003, 64 pages.

(Continued)

*Primary Examiner* — Kristyn A Hall

(74) *Attorney, Agent, or Firm* — Cantor Colburn LLP

(57) ABSTRACT

An inflow control device includes a flow device having an inlet; an outlet; a flow path fluidically connecting the inlet to the outlet; and a feature configured to reduce a mass flow rate of liquids to the outlet, the liquids having a subcool less than a predetermined subcool for a selected drawdown pressure, lower than a mass flow rate of liquids having a subcool greater than the predetermined subcool at the selected drawdown pressure.

20 Claims, 13 Drawing Sheets

(56) References Cited

U.S. PATENT DOCUMENTS

| | | | |
|---|---|---|---|
| 2015/0267522 | A1 | 9/2015 | Frederick et al. |
| 2015/0354330 | A1 | 12/2015 | Stahl et al. |
| 2016/0098502 | A1 | 4/2016 | Havre et al. |
| 2016/0281494 | A1 | 9/2016 | Shirdel et al. |
| 2016/0369591 | A1 | 12/2016 | Vachon |
| 2017/0058655 | A1 | 3/2017 | Lastiwka |
| 2017/0307772 | A1 | 10/2017 | Jutila et al. |
| 2017/0314367 | A1 | 11/2017 | Vachon |
| 2019/0178065 | A1 | 6/2019 | Stolboushkin et al. |
| 2019/0178069 | A1 | 6/2019 | Stolboushkin |

OTHER PUBLICATIONS

Wilson, Adam "Simulation of Flow-Control Devices with Feedback Control for Thermal Operations", Journal of Petroleum Technology, 2014, pp. 69-70.

International Search Report and Written Opinion for International Application No. PCT/US2018/060049; International Filing Date Nov. 9, 2018; Report dated Mar. 4, 2019 (pp. 1-6).

International Search Report and Written Opinion for International Application No. PCT/US2018/060055; International Filing Date Nov. 9, 2018; Report dated Feb. 1, 2019 (pp. 1-9).

International Search Report and Written Opinion for International Application No. PCT/US2018/060059; International Filling Date Nov. 9, 2018; Report dated Mar. 4, 2019 (pp. 1-6).

International Search Report and Written Opinion for International Application No. PCT/US2018/060063; International Filing Date Nov. 9, 2018; Report dated Feb. 19, 2019 (pp. 1-13).

Lecoffre, Yves "Applications of Cavitation", Cavitation Bubble Trackers, 1999, Chapter 15, pp. 363-367.

* cited by examiner

INFLOW CONTROL DEVICE AND SYSTEM HAVING INFLOW CONTROL DEVICE

BACKGROUND

In the resource recovery industry, resources (such as hydrocarbons, steam, minerals, water, metals, etc.) are often recovered from boreholes in formations containing the targeted resource. Many wells include long horizontal sections of a production well, where the resources in the formation include both liquid and gas phases. When only the liquid is desired as the targeted resource, the gas produced with the liquid is a waste product. Gas breakthrough into the well reduces production from other zones and lowers overall recovery of liquids.

In a steam assisted gravity drainage (SAGD) system, an injection well is used to inject steam into a formation to heat the oil within the formation to lower the viscosity of the oil so as to produce the liquid resource (mixture of oil and water) by a production well. The injector well generally runs horizontally and parallel with the production well. Steam from the injector well heats up the thick oil in the formation, providing the heat that reduces the oil viscosity, effectively mobilizing the oil in the reservoir. After the vapor condenses, the liquid emulsifies with the oil, the heated oil and liquid water mixture drains down to the production well. An ESP is often used to pull the oil and water mixture out from the production well. Water and oil go to the surface, the water is separated from the oil, and the water is reinjected back into the formation by the injector well as steam, for a continuous process.

Inflow control devices (ICDs) are used to even out production from sections of the horizontal production well. Without ICDs, the heel of the production well may produce more of the targeted resource than the toe of the production well. Likewise, heterogeneities in the reservoir may result in uneven flow distributions. The ICDs are employed to impose pressure distribution along the wellbore to control and distribute the production rate along the wellbore.

Due to irregularities in formations in which the steam is injected, the heat from the steam may not be distributed through the formation evenly, resulting in uneven production results.

The art would be receptive to alternative and improved devices and methods to reduce unwanted gas production and breakthrough in the resource recovery industry.

SUMMARY

An inflow control device includes a flow device having an inlet; an outlet; a flow path fluidically connecting the inlet to the outlet; and a feature configured to reduce a mass flow rate of liquids to the outlet, the liquids having a subcool less than a predetermined subcool for a selected drawdown pressure, lower than a mass flow rate of liquids having a subcool greater than the predetermined subcool at the selected drawdown pressure.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
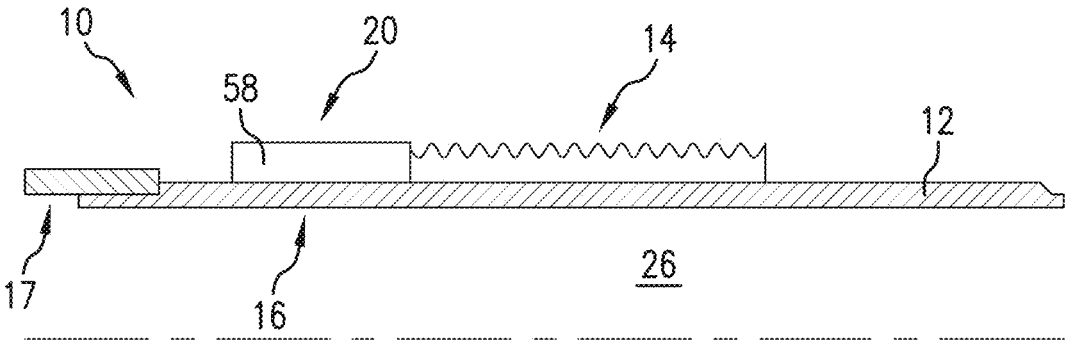
FIG. 1 depicts a partial sectional and schematic view of an embodiment of an inflow control device (ICD)
Figure 2:
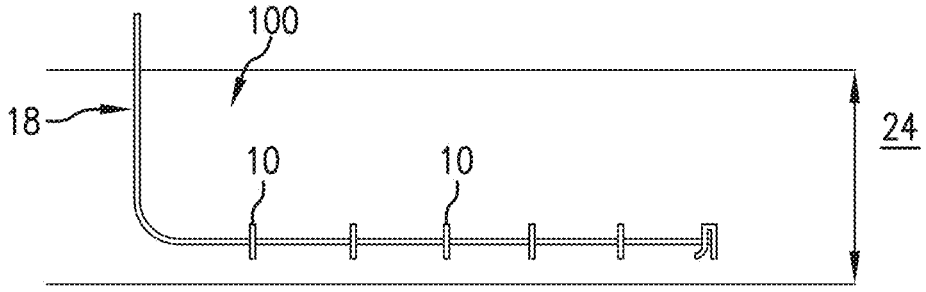
FIG. 2 depicts a schematic view of an embodiment of a tubular system incorporating the ICD of FIG. 1.
Figure 3:
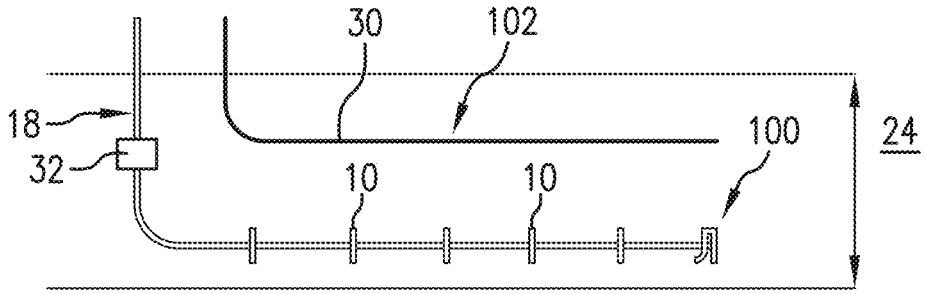
FIG. 3 depicts a schematic view of another embodiment of a tubular system incorporating the ICD of FIG. 1.

According to embodiments described herein, and with reference to FIG. 1, an inflow control device (ICD) 10 is usable with a tubular system 100 (FIGS. 2 and 3). In some embodiments, the ICD 10 can be used to reduce gas breakthrough and/or gas production into the tubular system 100, and/or to control a thermal gradient in a formation 24 (FIGS. 2 and 3). The ICD 10 is particularly useful with a production tubular 12, which may refer to, but is not limited to, one or more of a screen 14, liner, casing, piping, base pipe 16, coupling 17, and production string, all of which are disposed within a borehole, such as, but not limited to a borehole of a production well 18. The ICD 10 includes a flow device 20 having an outlet 22 (FIGS. 4 and 5) and the screen 14. The ICD 10 is mounted on the base pipe 16 which is in fluid communication with the outlet 22 of the ICD 10. The base pipe 16 is at least part of the production tubular 12, and disposed radially interiorly of the ICD 10. Flow from a formation 24 enters the ICD 10 through the screen 14. Sand from the formation 24 is screened out of the ICD 10 by the screen 14, such that substantially only fluid is within the flow within the ICD 10. From the screen 14, the fluid flow travels longitudinally to the flow device 20, travels through the flow device 20, and is then exhausted through the outlet 22 and into the interior 26 of the base pipe 16. As will be further described below, embodiments of the ICD 10 reduce the gas mass flow rate for a given drawdown, allow for higher rates of production of targeted liquid resources and increased overall recovery, and control the thermal gradient of the formation 24.

FIGS. 2 and 3 schematically depict embodiments of the tubular system 100 in which the ICD 10 can be employed, although the ICD 10 may be employed in other embodiments of tubular systems 100. The tubular systems 100 each include a production well 18 having a long horizontal section 28. A plurality of the ICDs 10 can be utilized and spaced longitudinally with respect to a production string to impose pressure distribution along the production borehole to control and distribute the production rate along the production well 18. The ICD 10 is applicable to production wells 18 that pass through reservoirs having fluids in both gas and liquid phases, such as demonstrated in FIG. 2. The concentration of gas in the formation 24 may vary. This concentration can be as high as 100%, but can also be small mass fractions, such as 1% by mass or less. Evening out the production helps to reduce gas breakthrough into the production well 18. The production well 18 closer to the origin of gas will produce more gas due to the higher concentration of gas in such a region.

As demonstrated in FIG. 3, the ICD 10 is also usable with a production well 18 that is employed in a gas driven well tubular system 100 where gas is injected to push liquid out of the formation 24, such as, but not limited to, steam assisted gravity drainage (SAGD) system 102, where an injection well 30 is used to inject steam into the formation 24 to heat heavy crude oil and bitumen to reduce the viscosity thereof, causing the heated oil to drain towards the production well 18 as liquid. The liquid (such as oil and water mixture) is then produced by the production well 18.

In either system 100, an electric submersible pump (ESP) 32 may be employed within the production well 18 for reducing pressure in the well 18 downhole of the ESP 32 and increasing the drawdown. The drawdown is the difference between the reservoir pressure in the formation 24 and the pressure in the interior 26 of the production tubular 12. In one embodiment, the ESP 32 in the SAGD system 102 may be limited to about 1.5% steam mass fraction, but since it is undesirable to reduce the pump rate of the ESP 32 in order to limit the production of steam in an ICD 10, because that would deleteriously impact the production flow rate, embodiments of the ICD 10 described herein additionally provide for a reduced mass flow rate as a function of increasing gas fraction for a given pressure drop across each ICD 10.

Figure 4:
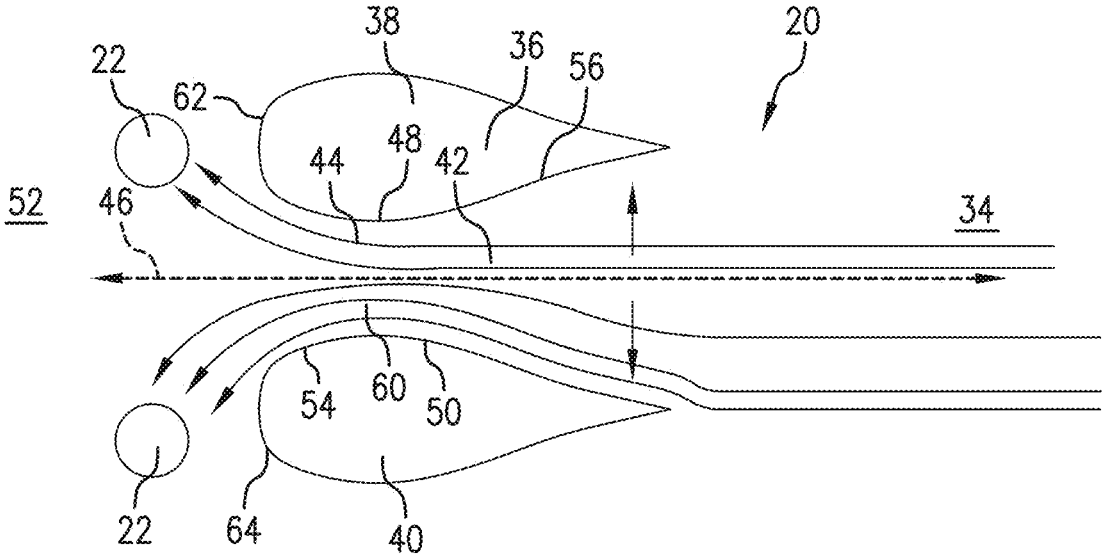
FIG. 4 depicts a schematic view of an embodiment of a flow device for use in the ICD of FIG. 1, where unseparated flow is depicted as flowing through the device.
Figure 5:
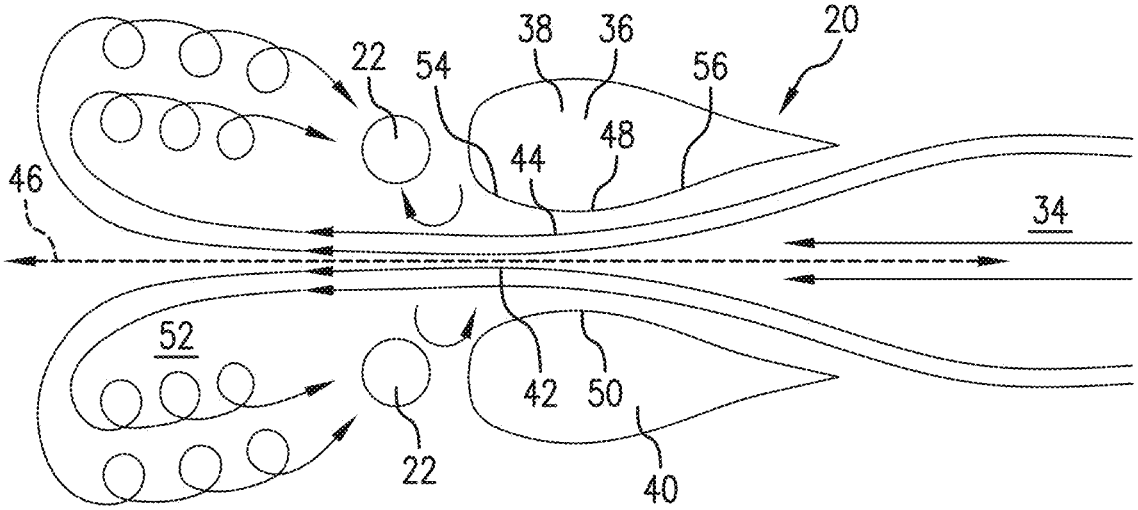
FIG. 5 depicts a schematic view of the flow device of FIG. 4, where separated flow is shown flowing through the device.

FIGS. 4 and 5 show an embodiment of the flow device 20 of the ICD 10. The flow device 20 is at least partially wrapped around the base pipe 16 (FIG. 1), and is depicted in the illustrated embodiment of FIGS. 4 and 5 in a flattened-out schematic view. The flow comes in from the screen 14 (FIG. 1) into an inlet 34 of the flow device 20, and then goes into the base pipe 16 (FIG. 1) through an outlet 22. The flow device 20 further includes a body 36 having a first body portion 38 and a second body portion 40, the first body portion 38 and the second body portion 40 each defining a portion of a fluid flow path 42. The body 36 may extend from the base pipe 16 on a radially interior side to a housing 58 (FIG. 1) on a radial exterior side, although the body 36 and the housing 58 may be integrally formed. Further, while first and second body portions 38 and 40 are illustrated as two separate bodies, the body 36 may be integrally connected and wrapped around the base pipe 16 with the fluid flow path 42 passing therethrough. A first end of the fluid flow path 42 is defined by the inlet 34. In the illustrated embodiment, the fluid flow path 42 includes a converging-diverging nozzle 44 between the first body portion 38 and the second body portion 40. The inlet 34 leads to a converging portion 56 of the nozzle 44. The nozzle 44 has a centerline 46 disposed between the first and second body portions 38, 40, and the centerline 46 is parallel with a longitudinal axis of the base pipe 16. The first and second body portions 38, 40, as illustrated, each have curved peripheral surfaces 48, 50. A height of the peripheral surfaces 48, 50 extends radially outwardly with respect to the base pipe 16 and from the base pipe 16 to the housing 58. A length of the peripheral surfaces 48, 50 extends a longitudinal section of the flow device 20, and the peripheral surfaces 48, 50 also curve such that a distance from the centerline 46 to the peripheral surfaces 48, 50 is variable depending on the longitudinal location of the peripheral surface 48, 50. The nozzle 44 is defined by the first curved peripheral surface 48 of the first body portion 38 and the second curved peripheral surface 50 of the second body portion 40. The first and second body portions 38, 40 further include first and second end surfaces 62, 64 that each extend divergently from the nozzle 44 and the centerline 46. The first and second end surface 62, 64 are continuous with the first and second peripheral surfaces 48, 50, respectively. While the first and second peripheral surfaces 48, 50 extend generally in a longitudinal direction and face generally in opposite circumferential directions, the first and second end surfaces 62, 64 extend generally in opposite circumferential directions and face generally in the same longitudinal direction (more particularly, in an uphole direction). The outlet 22 is spaced from the nozzle centerline 46, and in the illustrated embodiment a pair of outlets 22 is spaced from the centerline 46, such as equidistantly spaced from the centerline 46. The outlet 22 is in fluid communication with the fluid flow path 42 and the base pipe 16 (FIG. 1), and the first and second body portions 38, 40 are disposed respectively between the outlets 22 and the nozzle 44. The fluid flow path 42 further includes a recirculation area 52 downstream of a diverging portion 54 of the nozzle 44. The outlet 22 is located longitudinally between the recirculation area 52 and the diverging portion 54 of the nozzle 44, with respect to the centerline 46 of the nozzle 44, and located adjacent to and uphole of the first and second end surfaces 62, 64. The housing 58 (FIG. 1) traps fluid flow within the flow path, preventing the general escape of the flow. The housing 58 is sized such that the flow within the recirculation area 52 will eventually be directed to the outlet 22.

FIG. 4 also depicts an embodiment of the flow device 20 with liquid passing through the ICD 10. Streamlines represent the ideal flow when the fluid is all liquid, and when the ICD 10 is operating under conditions such that steam production is not initiated within the ICD 10, as will be further described below. The liquid flow within the flow device 20 of the ICD 10 shown in FIG. 4 does not substantially separate from the first and second curved peripheral surface 48, 50, and enters the outlet(s) 22 and following the first and second end surfaces 62, 64 with minimum chaotic flow. In particular, the liquid flow will travel longitudinally through the nozzle 44, relatively parallel to the longitudinal axis of the base pipe 16, and then will travel in a direction circumferentially with respect to the base pipe 16 to reach the outlets 22. The flow will then travel in a radially interior direction to enter the base pipe 16. The flow path from the inlet 34 through the nozzle 44 to the outlet 22 is formed by the first and second peripheral surfaces 48, 50 and the first and second end surfaces 62, 64, and can be further defined by the housing 58 on the radial exterior side of the flow path and the base pipe 16 on a radial interior side, although the housing 58 may further have a radial interior surface to define the radial interior side between the base pipe 16 and the flow path. Further, the liquid substantially follows the first and second curved peripheral surface 48, 50 and the end surfaces 62, 64 to the outlets 22 and, for the most part, does not enter the recirculation area 52. Liquid is more viscous than gas, and will travel more slowly than gas, so there will be an orderly pathway to the outlets 22 when the fluid flow is liquid.

FIG. 5 shows streamlines for a gas flow. Due to the Bernoulli Effect, flow will accelerate in the converging portion 56 to the throat 60 of the nozzle 44 between the first and second body portion 38, 40. Gas or gassy mixtures will additionally have lower viscosity than liquids. The higher velocity and lower viscosity will induce boundary layer separation after the throat 60 of the nozzle 44, between the converging portion 56 and the diverging portion 54, and between the first and second body portion 38, 40. The gas or gassy mixtures will jet the flow longitudinally past the outlet 22 and into the recirculation area 52. The flow will still return to the outlets 22 due to the lower pressure within the base pipe 16. The flow will thus have to reverse directions after jetting from the throat 60 into the recirculation area 52, and this will induce significant chaos in the flow. This is exasperated by the jetted fluid flow from the nozzle 44 going in a first direction (from the nozzle 44 to the recirculation area 52) and the reversed flow going in a substantially opposite direction (from the recirculation area 52 back towards the nozzle 44, in the longitudinal direction, and then in a circumferential direction towards the outlet 22). This chaotic flow will consume available flow energy in the form of frictional losses in the fluid. This will result in a lower mass flow rate for gas then liquid for a given pressure drop. For mixtures of gas and liquid, multiphase regimes will occur, but some intermediate behavior will occur. For flow that contains a mixture of liquid and vapor, or flow that contains some gas, the gas will go through the converging portion 56 of the nozzle 44 faster than the liquid. The mixture will have less viscosity than pure liquid and when it passes through the converging portion 56 it will separate from the body and will initially bypass the outlets 22 and will have to turn around and do some recirculation to get back to the outlets 22. Because the mixture has built up the momentum of going through the nozzle 44, it is not able to make the turn as shown in FIG. 4, so the flow has to turn around at a further longitudinal location with respect to the nozzle centerline 46 in order to enter the outlet 22.

With reference again to the SAGD system 102 described with respect to FIG. 3, while the steam injection from the injection well 30 can be balanced so as to substantially evenly dispense the steam to the formation 24, the horizontal section 28 of the production well 18 of the SAGD system 102 may be very long and certain locations may experience higher temperatures than other locations. Heat transfer may be higher in these "hot spots" due to more steam going into a particular zone, such as what may occur due to differences in porosity of the formation 24. It would be desirable to reduce the mass flow rate from the ICDs 10 in these locations so that the heat from any "hot spot" gets transferred to other zones. That is, it would be desirable to choke the zone(s) that has a temperature greater than a predetermined temperature so that more of the steam goes to the other zones.

Figure 6:
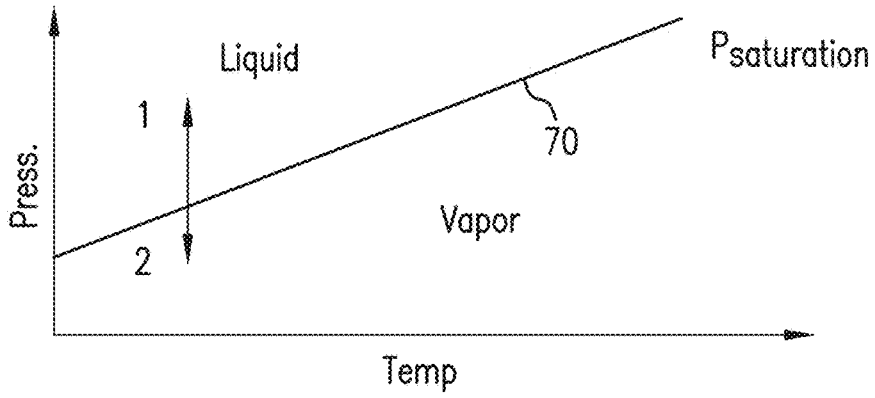
FIG. 6 depicts a graph of a saturation curve.

With continued reference to FIG. 3, and additional reference to the thermodynamic diagram for water shown in FIG. 6, when steam is injected into the formation 24 from the injection well 30, it condenses to combine with the oil, and the resultant fluid mixture is pulled out of the production well 18. The process of pulling the fluid out creates a pressure drop. The Y axis in the graph of FIG. 6 indicates pressure, the X axis indicates temperature, and the curve represents a saturation curve 70. A fluid that exists on the saturation curve 70 will exist in some combination of steam and gas and liquid. Fluid above the curve 70 will be all liquid, also termed subcooled liquid. Fluid below the curve 70 will be all gas, also termed superheated steam. The fluid in the formation 24 entering the ICD 10 in the SAGD system 102 exists in a condition 1, the subcooled liquid. However, if the pressure drop experienced by the liquid is significant enough within the flow device 20, the fluid can drop to condition 2, saturated mixture with evolved steam or even superheated steam. Condition 2 can also lie on the saturation curve 70, wherein some mixture of steam and liquid occurs. That is, in the SAGD system 102, steam occurs when the drawdown pressure causes the fluid to go from the subcooled state to a superheated or saturated condition.

Figure 7:
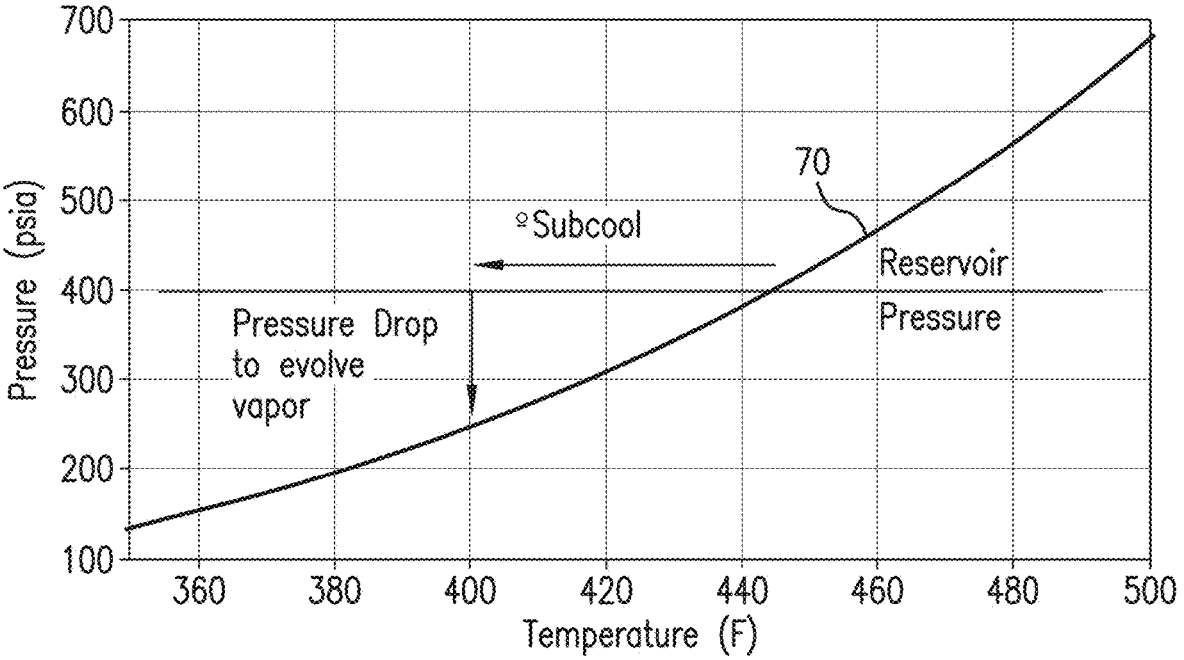
FIG. 7 depicts a graph illustrating the intersection of an inlet flow temperature and the saturation curve of FIG. 6 to determine the pressure drop required to induce steam formation within the ICD.

SAGD wells in the SAGD system 102 are designed to operate at a certain amount of subcool, which is the difference between the saturation temperature at the well pressure and the temperature of the fluid entering the well. Lowering subcool increases recovery efficiency, but also promotes steaming in localized hotspots. In FIG. 7, "B" shows the allowable pressure drop before flashing occurs. If one of the zones has a smaller subcool, due to hotspots, the pressure drop B will cause flashing. In a conventional ICD, this could result in steam production in the production well and require a lowering of the ESP pump rate. However, embodiments of the ICD 10 described herein advantageously utilize the flashing to steam to choke the flow through that ICD 10, as will be described further below.

Figure 8:
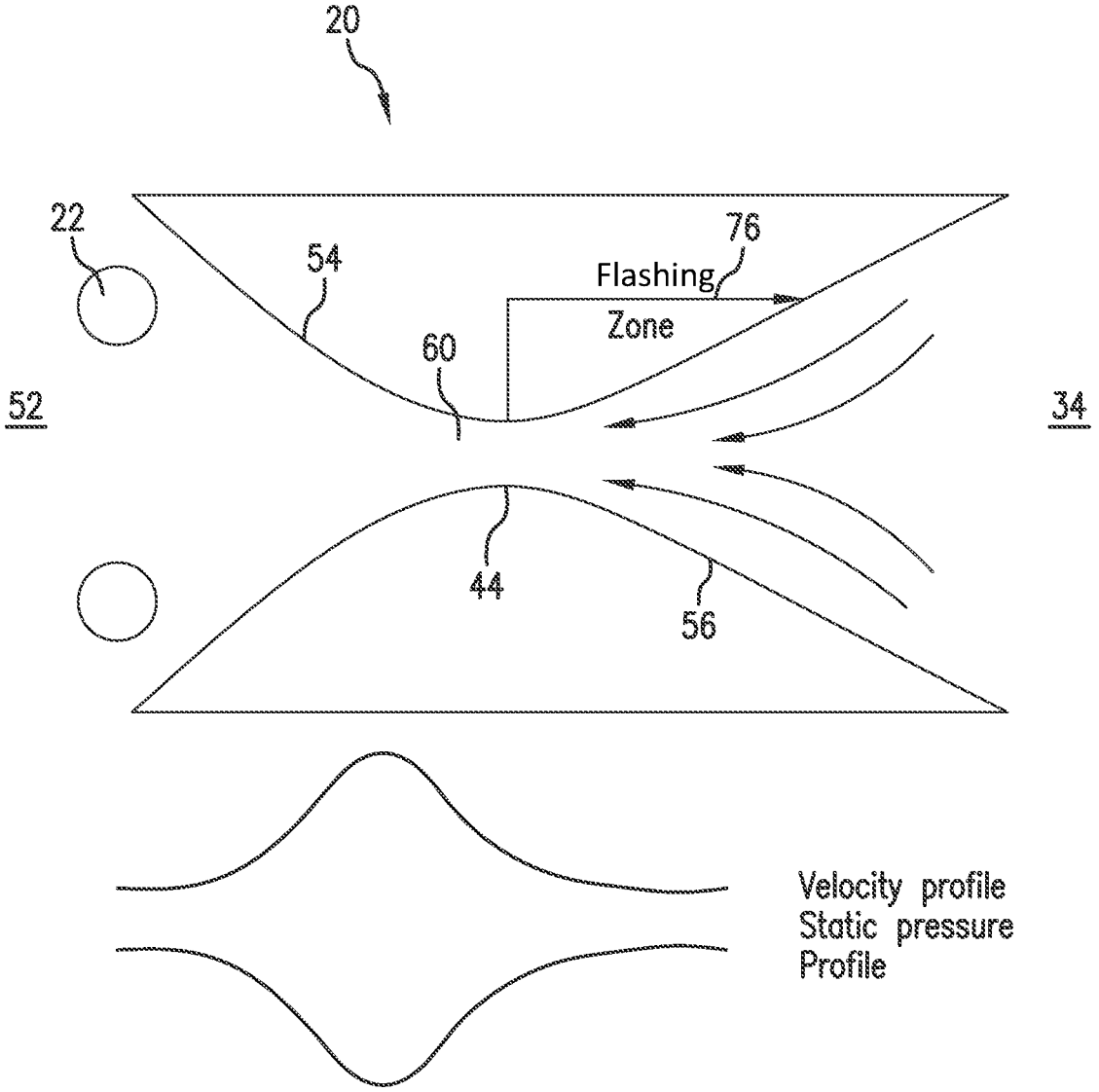
FIG. 8 depicts a schematic view of the flow device of FIG. 4, where the flashing or steam-generation zone is indicated and the relationship between the velocity and static pressure of flow through the flow device is shown.

The flow device 20 described with respect to FIGS. 4 and 5 is illustrated again in FIG. 8 to demonstrate how the flow device 20 will operate for SAGD conditions. The flashing zone 76 extends from the throat 60 of the nozzle 44. Velocity of the fluid increases in the converging portion 56 of the nozzle 44 and causes a decrease in static pressure. Flow entering the converging portion 56 will accelerate, and acceleration causes a decrease in static pressure. Depending on the temperature of the fluid, sufficient drop in static pressure will cause the fluid to drop to the saturation curve 70 and flashing will occur (see again the graphs shown in FIGS. 6 and 7). The flashing occurs in the converging portion or immediately after the throat 56 of the nozzle 44 due to the acceleration and the corresponding pressure drop. Once steam production is initiated within the nozzle 44, flow will separate from the first and second body portion 38, 40 and go through a chaotic regime within the recirculation area 52, as previously described with respect to FIG. 5.

For example, if the liquid has a pressure of 600 psi in the formation 24, depending on the temperature of the liquid at the inlet 34, when the pressure of the water within the liquid is dropped due to acceleration of the water through the nozzle 44, the liquid water may flash into a saturate with some steam. For reference, the saturation temperature of water at 600 psi is 486° F. In the production well 18, the temperature at each ICD 10 will be known. In one example, if a first ICD 10 is positioned within a zone where fluid is entering the inlet 34 at 462° F., the fluid is coming in below the saturation temperature of 486° F., so the fluid is coming in as all liquid. If a second ICD 10 is positioned within a zone where fluid is coming in at 475° F., which is also coming in below the saturation temperature of 486° F., the fluid coming into the second ICD 10 is also coming in through the inlet 34 as all liquid. In one example, in the reservoir that has a pressure of 600 psi, 15° F. subcool may be a desired operating point, where subcool is the difference between saturation temperature and the local actual temperature for the reservoir pressure. With the second ICD at 11° subcool, which is less than the desired operating subcool, reducing the mass flow rate through the second ICD 10, and thus choking the flow through the second ICD 10, will drive steam that is being injected from the injection well 30 to the other zones, to provide a more even heat distribution.

Figure 9:
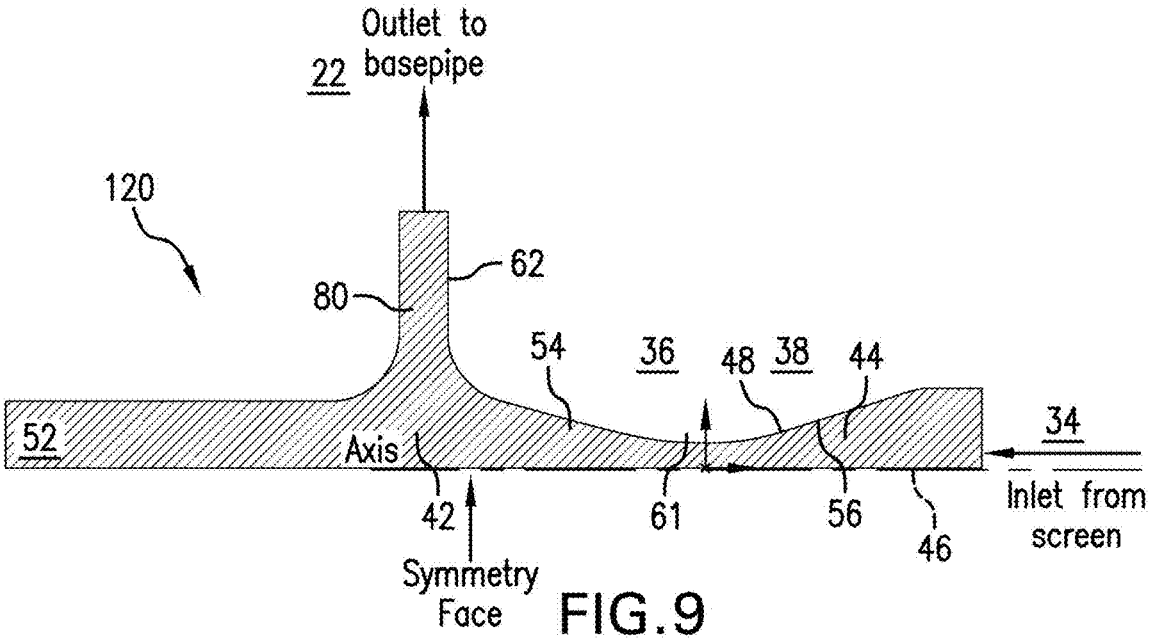
FIG. 9 depicts a partial sectional view of another embodiment of a flow device for the ICD of FIG. 1.

FIG. 9 shows another embodiment of the flow device 120. The flow device 120 shown in FIG. 9 is similar to the flow device 20 shown in FIGS. 4 and 5 except that the outlet 22 is spaced even further from the centerline 46 of the nozzle 44 by a channel 80. Also, the throat 61 may have a longer longitudinal length than the throat 60 of the flow device 20 shown in FIGS. 4 and 5. The recirculation area 52 extends longitudinally with respect to the centerline 46, and a width of the recirculation area 52, measured circumferentially, is approximately a same width of the end of the diverging portion of the nozzle 44. Thus, any recirculated fluid from the recirculation area 52 is forced to mainly travel back in the longitudinal direction (a downhole direction) before being able to flow in a circumferential direction through the channel 80. While only one half of the flow device 120 is shown in FIG. 9, it should be understood that the flow device 120 may be symmetrical about the centerline 46, such that the flow device 120 also includes a second body portion 40 and a second outlet 22, as in the flow device 20 shown in FIGS. 4 and 5.

Figure 10:
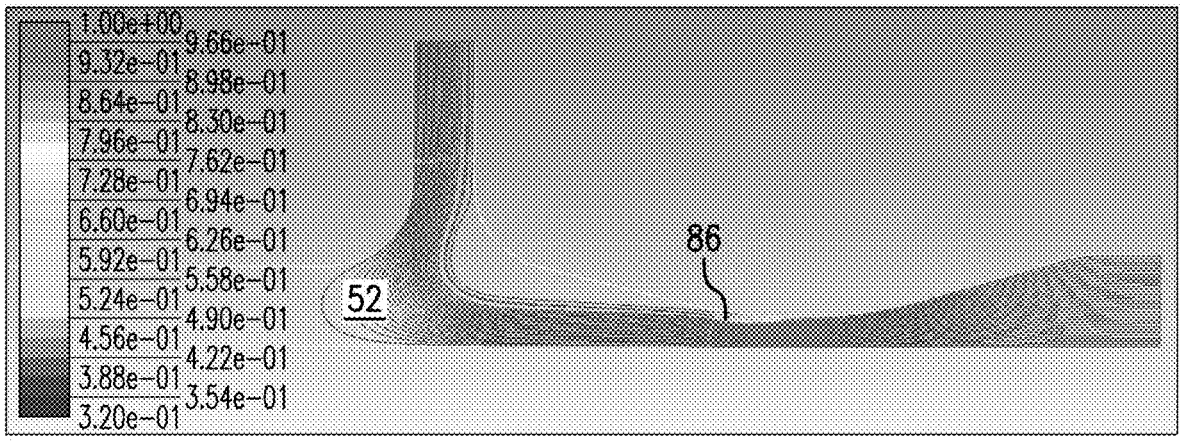
FIG. 10 depicts flow through the flow device of FIG. 9 when cavitation occurs in the flow.

FIG. 10 illustrates an example of flow through the flow device 120 of FIG. 9 where the temperature of the fluid at the inlet 34 is 475° F. If the pressure at the inlet 34 (from the reservoir) is 600 psi, and the pressure at the outlet 22 (into the base pipe 16) is 575 psi, but the pressure at the throat 61 of the nozzle 44 drops to 545 psi because of the increased velocity of the fluid through the converging portion 56, then cavitation within the fluid will occur. That is, bubbles within the fluid will be formed as a consequence of the rapid drop in pressure. This area of cavitating flow, or bubbles, is illustrated as cavitating flow region 86, which has a lower volume fraction of liquid, such as 0.2% by volume liquid, than the surrounding liquid. The flow lines depict an example of what occurs within the flow device 120 due to the cavitating flow region 86. Bubbles put a layer between the liquid and the body 36, particularly the body 36 formed of a metal. There is also very little viscosity in the bubbles, so the flow separates from the body 36 and travels substantially straight from the nozzle 44, substantially following and substantially in parallel with the centerline 46 of the nozzle 44, towards the recirculation area 52 before the flow turns to go out towards the outlet 22 through channel 80. The pressure of the flow exiting the diverging portion 54 of the nozzle 44 increases to the point that the pressure in the outlet 22 is lower than the pressure in the recirculation area 52, and therefore the pressure difference drives the flow from the recirculation area 52 to the outlet 22. Also, the steam bubbles created in the cavitating flow region 86 collapse so that all of the flow exiting the outlet 22 will be liquid. However, the effect of the bubbles in the nozzle 44 is that they choke the mass flow rate to slow down the mass flow rate through the flow device 120. The mass flow rate is reduced by both separating the flow from the body 36, resulting in a tighter constriction to turn outward, as well as effectively reducing the throat size downstream of the throat 61. Thus, if a zone has a greater temperature than surrounding zones, then an ICD 10 can be designed to choke out the flow in that zone, so as to direct the injected steam to the other zones, thus controlling the thermal gradient in the formation 24.

Figure 11:
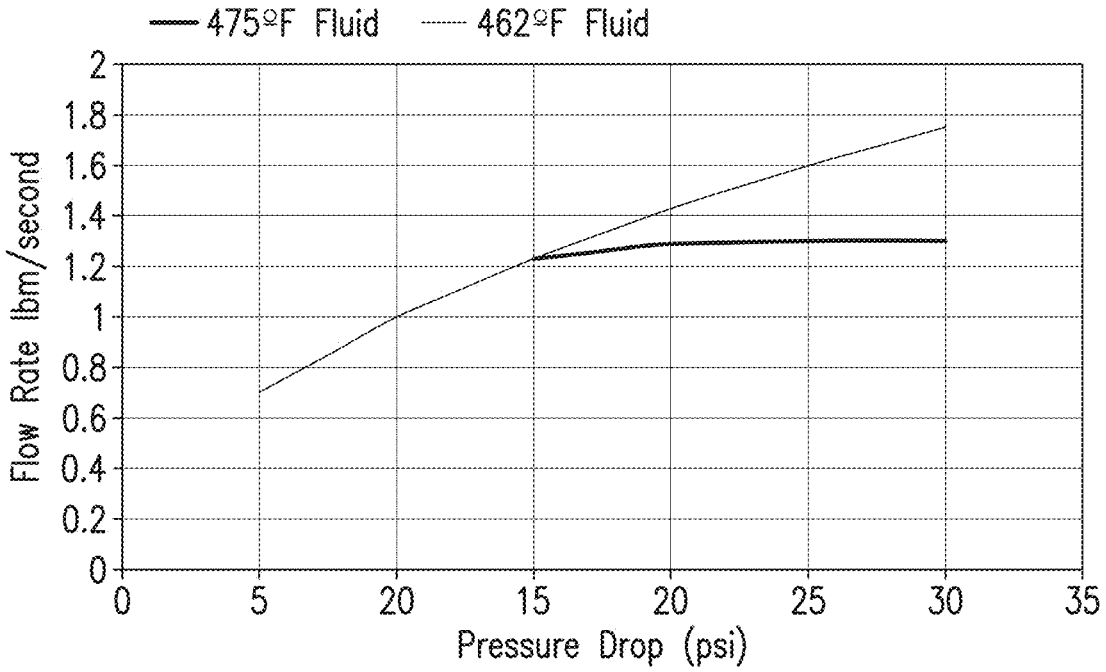
FIG. 11 depicts a graph of pressure drop vs. flow rate in cavitated and non-cavitated flows.

FIG. 11 shows what occurs in first and second ICDs 10 having the same construction and operating within a formation 24 having the same reservoir pressure (600 psi), but having different fluid temperatures at their respective inlets 34. When the first ICD 10 is operating in a zone where the fluid entering the inlet 34 is at 462° F., when there is an increase in the pressure drop (pressure from inlet 34 to outlet 22) across the flow device 21 of the first ICD 10, there is no cavitation because of the cooler inlet temperature, and the flow rate will increase with increased pressure drop. Since the fluid passing through the first ICD 10 will not drop below the saturation pressure, there will be no vapor formation and the fluid flow will continue on completely as liquid. However, in the second ICD 10 which operates in a zone where the fluid entering the inlet 34 is at 475° F., the fluid begins to cavitate. Even if the pressure drop is increased beyond a pressure drop of 15 psi, the flow rate will not increase through the second ICD 10. A target pressure drop for a SAGD production well 18 may be about 30 to about 50 psi, and the higher the pressure drop, the more the production well 18 will produce. If the production well 18 is designed to operate on about a 50 psi pressure drop, and all the fluid is coming in at 600 psi, the fluid that is at 475° F. coming through the second ICD 10 will only have to drop from 600 to 540 psi to become saturated and cavitate, whereas the fluid in the first ICD 10 would have to drop to approximately 475 psi for it to be saturated. Since the first and second ICDs 10 may be designed identically, such that they experience a same pressure drop within the flow device 21, only the second ICD 10 receiving the hotter fluid at the inlet 34 will start to form steam as a result of the pressure drop and therefore will experience the cavitation which will slow down the mass flow rate. Slowing down the mass flow rate will force the steam that is injected into the formation 24 by the injection well 30 towards other zones. At the target pressure drop, the second ICD 10 operating within the hotter zone is effectively choked because of the cavitation. Because the second ICD 10 in the hotter zone is choked, and the other ICDs 10 in the cooler zones are not choked, the steam injected within the hotter zone will be diverted to the cooler zones and begin to heat the other zones. The end result of the SAGD system 102 using the ICDs 10 is that the temperature distribution in the zones will become more uniform, as compared to a SAGD system 102 without the ICDs 10, which has the effect of more uniformly distributing production across the production well 18.

Controlling the shape of the nozzle 44 between the first and second body portions 38, 40 can determine whether or not the ICD 10 will induce steam within a particular temperature and for a given drawdown. For example, using the same ICD 10 for a given drawdown pressure, 5° C. subcooled fluid will not flash and will flow to the outlet 22 in an orderly manner, whereas 3° C. subcooled fluid will flash and have a reduced mass flowrate. While ICDs are commonly described with a specific flow resistance rating (FRR), the flow device 20 of the ICD 10 according to embodiments described herein can instead be specified by the desired differential pressure and the desired subcool.

Embodiments of the ICD 10 include a fixed geometry. Due to the aggressive conditions in the well 18, the fixed geometry advantageously provides durability and reliability. The geometry of the ICD 10 enables boundary layer separation to occur when gas is present in the fluid. Gas flow separates from the body 36, resulting in the turbulent action of having to turn around in the recirculation area 52, which creates a choke because there is less mass flow rate of the gas. Gas takes a longer path to the outlet 22, thereby reducing the mass flow rate of gas into the base pipe 16. Further, even if the fluid flow entering the ICD 10 is all liquid, if operating close to the saturation point, a cavitating flow region 86 separates the fluid flow from the body 36, resulting in turbulent fluid flow and the creation of a choke. This will reduce the steam flow rate, allowing higher drawdown pressure, and improved economics.

Figure 12:
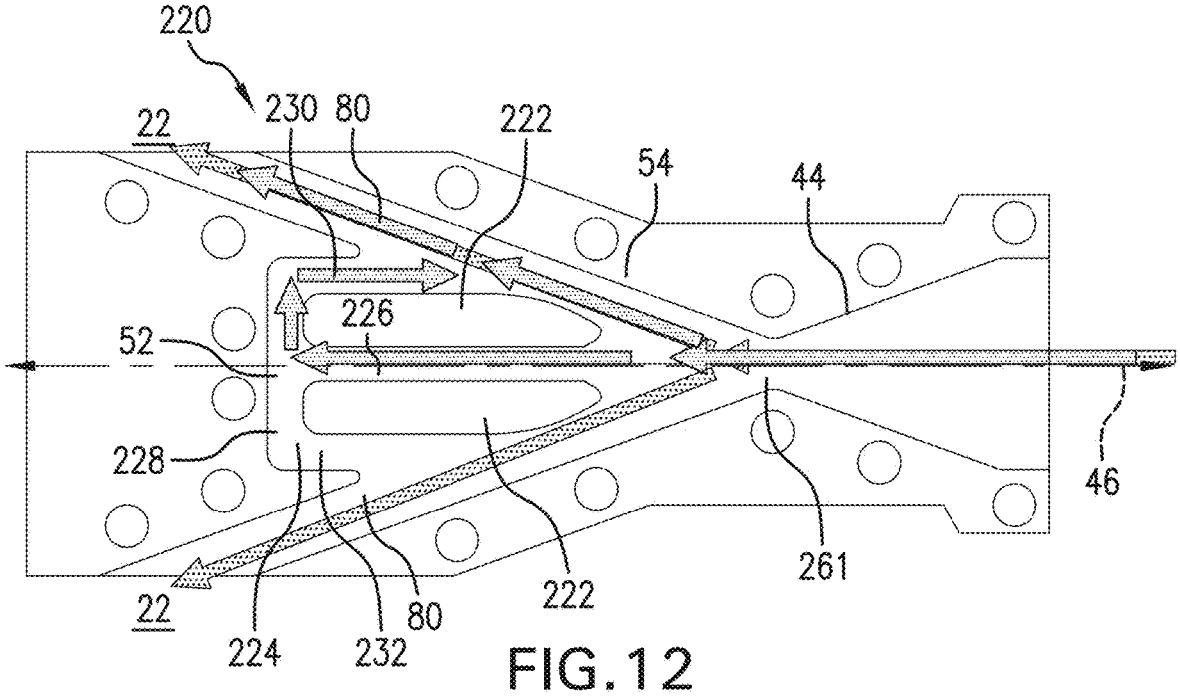
FIG. 12 depicts a schematic plan view of another embodiment of a flow device for the ICD of FIG. 1.
Figure 14:
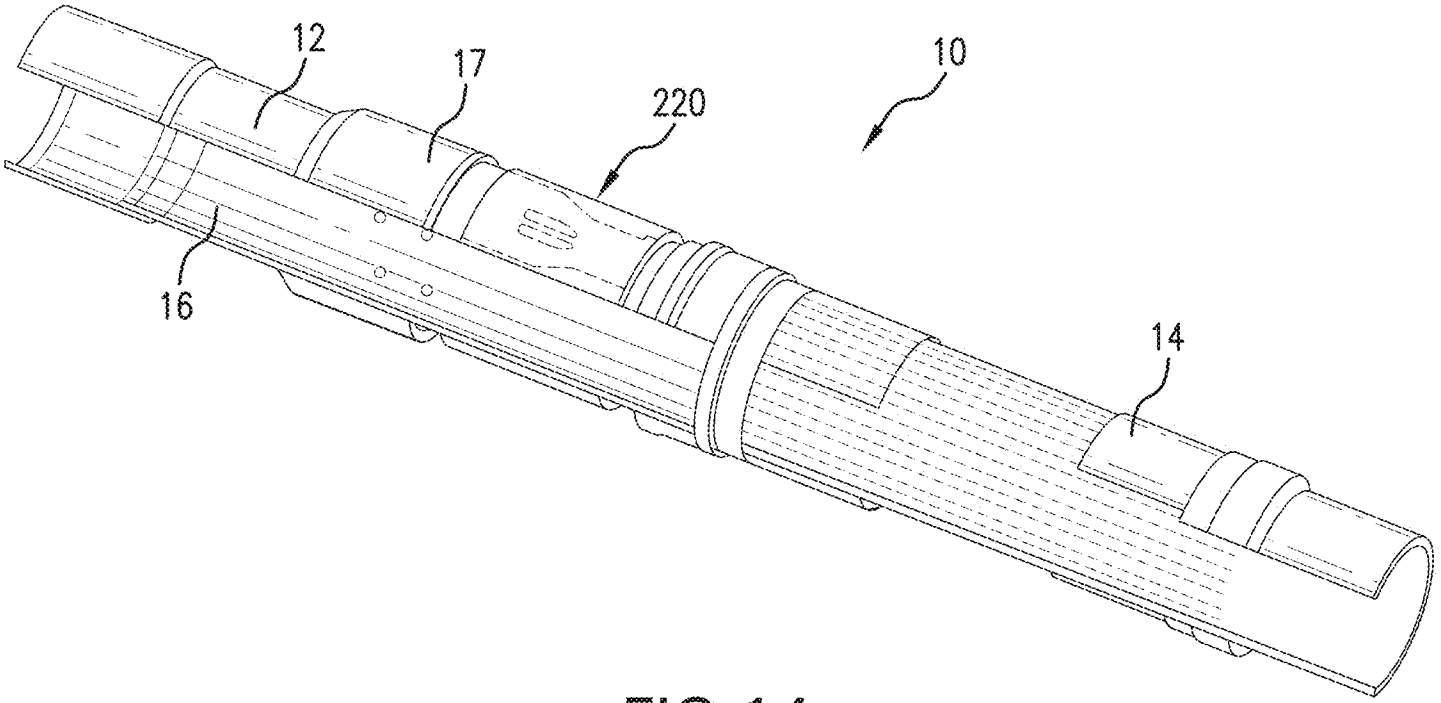
FIG. 14 depicts a perspective and cutaway view of the ICD including the flow device of FIG. 12.

Turning now to FIG. 12, another embodiment of a flow device 220 for the ICD 10 (see FIG. 14) is shown. The flow device 220 operates in substantially the same manner as the flow devices 20 and 120, but includes one or more baffles 222 downstream of the nozzle 44 that creates one or more tortuous paths 224 for the fluid exiting the nozzle 44. The outlet 22 is spaced from the centerline 46 of the nozzle 44 by channels 80. In the illustrated embodiment, one wall of each of the channels 80 is formed by the diverging portion 54 of the nozzle 44. The recirculation area 52 extends longitudinally with respect to the centerline 46 and contains, in the illustrated embodiment, two baffles 222 which divide the recirculation area 52 into the tortuous paths 224. The tortuous paths 224 include a first portion 226 following the centerline 46, a second portion 228 at the end of the first portion 226 and extending substantially perpendicularly to the first portion 226, and third and fourth portions 230, 232 (on opposite sides of the centerline 46) that connect the second portion 228 to the channels 80. Thus, any recirculated fluid from the recirculation area 52 is forced to mainly travel through the first portion 226, then change direction to enter the second portion 228, then change direction again to enter the third and fourth portions 230, 232 before substantially changing directions again to follow the channels 80 to the outlets 22. While two baffles 222 are illustrated, the flow device 220 may alternatively include additional baffles of varying shapes and sizes to create the tortuous paths 224.

Figure 13:
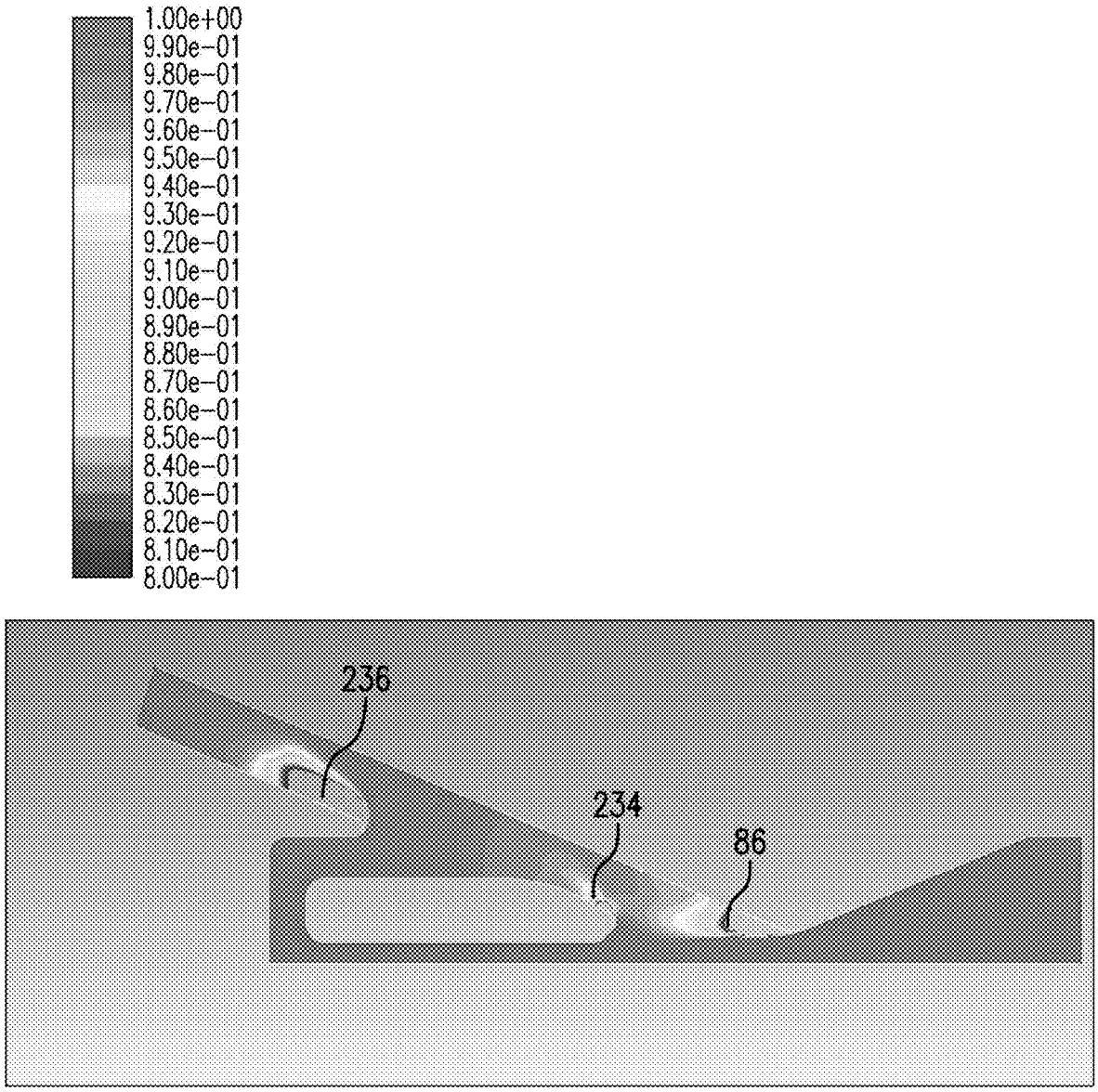
FIG. 13 depicts flow through the flow device of FIG. 12 when cavitation occurs in the flow.

FIG. 13 illustrates an example of flow through the flow device 220 of FIG. 12 with conditions that can cause cavitation. With reference to both FIGS. 12 and 13, and as in the flow shown in FIG. 10, a cavitating flow region 86 is located at the throat 261 of the nozzle 44 to separate the flow from the body 36. Some of the flow will travel straight from the nozzle 44 and straight into the first portion 226 of the tortuous paths 224 at which point such flow is forced to follow the second, third, and fourth portions of the paths 224 until it can enter the channels 80 to the outlets 22. Some of the flow, after separating from the body 36, will still flow into the channels 80 instead of the paths 224, however the flow will still experience additional cavitating flow regions 234, 236 at the beginning of the baffles 222 and at the intersection of the third and fourth portions 230, 232 and the channels 80, respectively. Thus, the multiple cavitating flow regions 86, 234, and 236 provide multiple opportunities for the fluid to cavitate and choke the mass flow rate to slow down the mass flow rate through the flow device 220. Thus, if a zone has a greater temperature than surrounding zones, then the ICD 10 having the flow device 220 can be designed to choke out the flow in that zone, so as to direct the heat from the injected steam to the other zones, thus controlling the thermal gradient in the formation 24.

Figure 15:
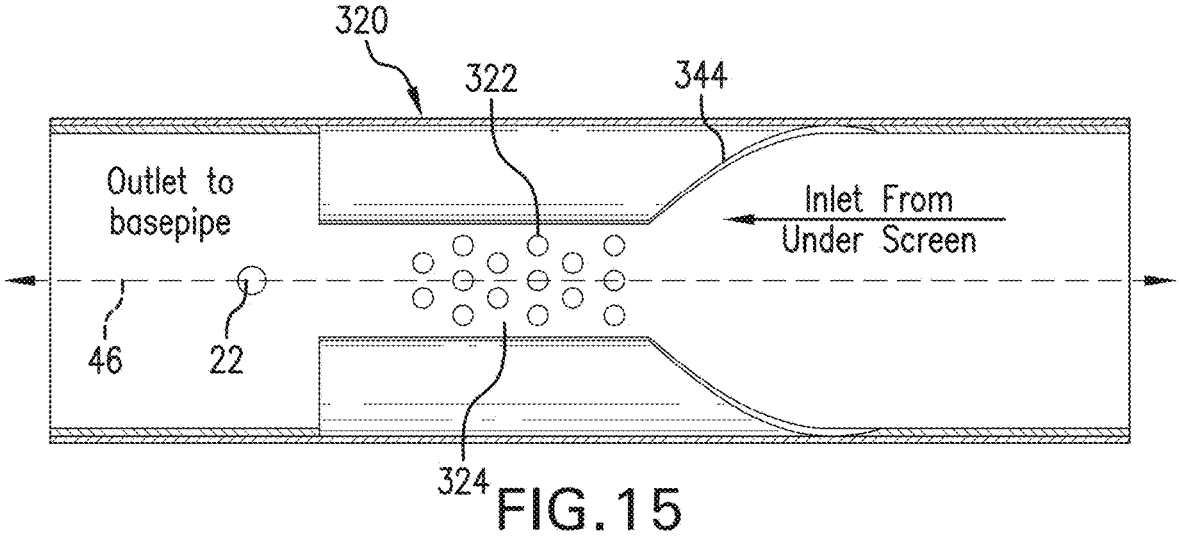
FIG. 15 depicts a schematic plan view of another embodiment of a flow device for the ICD of FIG. 1.
Figure 16:
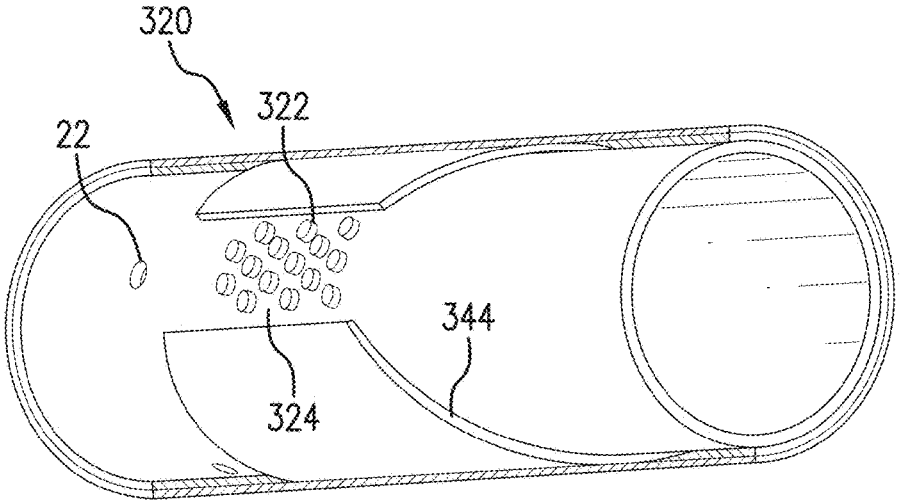
FIG. 16 depicts a perspective view of the flow device of FIG. 15.

FIGS. 15 and 16 show another embodiment of a flow device 320 for the ICD 10. The flow device 320 operates in substantially the same manner as the flow devices 20, 120, and 220. Instead of the shaped baffles 222 as in flow device 220, the baffles of the flow device 320 include a plurality of staggered pins 322 downstream of the nozzle 344 that creates a plurality of paths 324 between the pins 322 for the fluid exiting the nozzle 344. In this embodiment, the outlet 22 is in line with the centerline 46 of the nozzle 344. Flow coming from under the screen into the inlet 34 comes to the region with the staggered pins 322. The flow separates off the pins 322, causing regions of vaporization that hinder flow.

Figure 17:
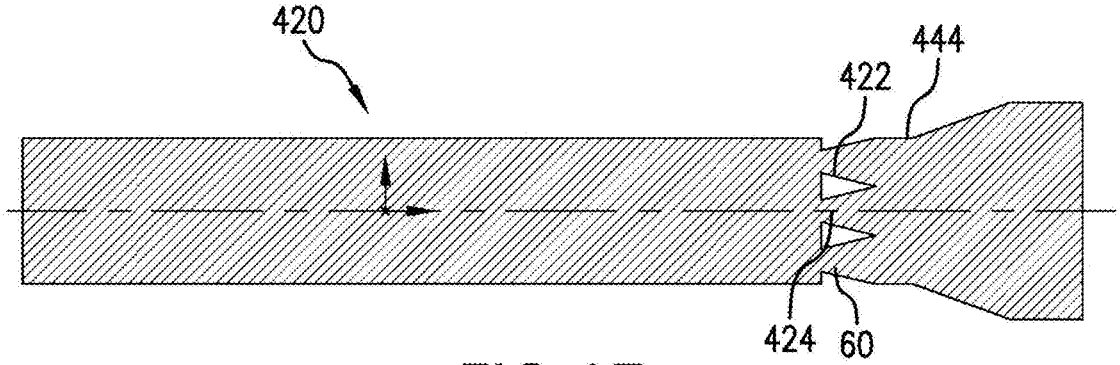
FIG. 17 depicts a schematic plan view of another embodiment of a flow device for the ICD of FIG. 1.
Figure 18:
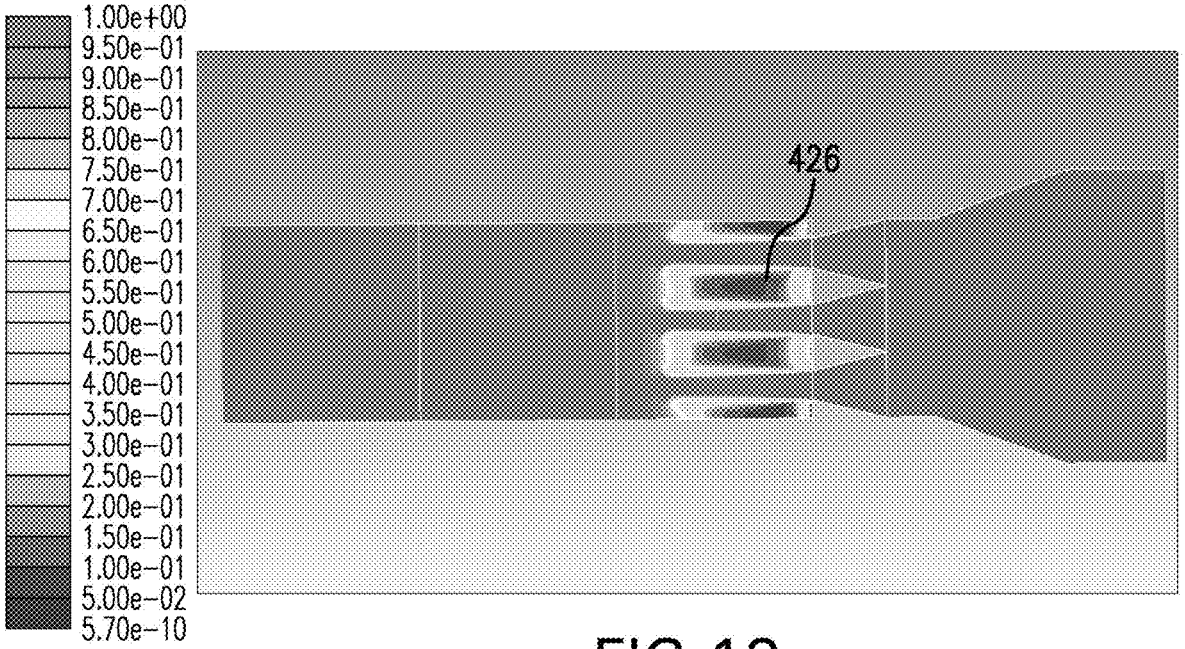
FIG. 18 depicts flow through the flow device of FIG. 17 when cavitation occurs in the flow.

FIG. 17 shows another embodiment of a flow device 420 for the ICD 10. The flow device 420 operates in substantially the same manner as the flow devices 20, 120, 220, and 320. The flow device 420 also includes baffles in the form of flow separators 422. The flow separators 422 are located in the throat 60 of the nozzle 444. In the illustrated embodiment, the flow separators 422 include triangular bodies configured such that the flow from the nozzle 444 contacts an apex of the flow separators 422 first. The spaces between the flow separators 422 form paths 424 for the flow. As shown in FIG. 18, when fluid is forced past the flow separators 422, the flow will separate into the separate paths 424 and remain in the separate paths before commingling again prior to reaching the outlet. Under appropriate conditions, this flow separation will cause vaporization in the cavitating flow regions 426 downstream of each flow separator 422 that will induce choking behavior.

Figure 19:
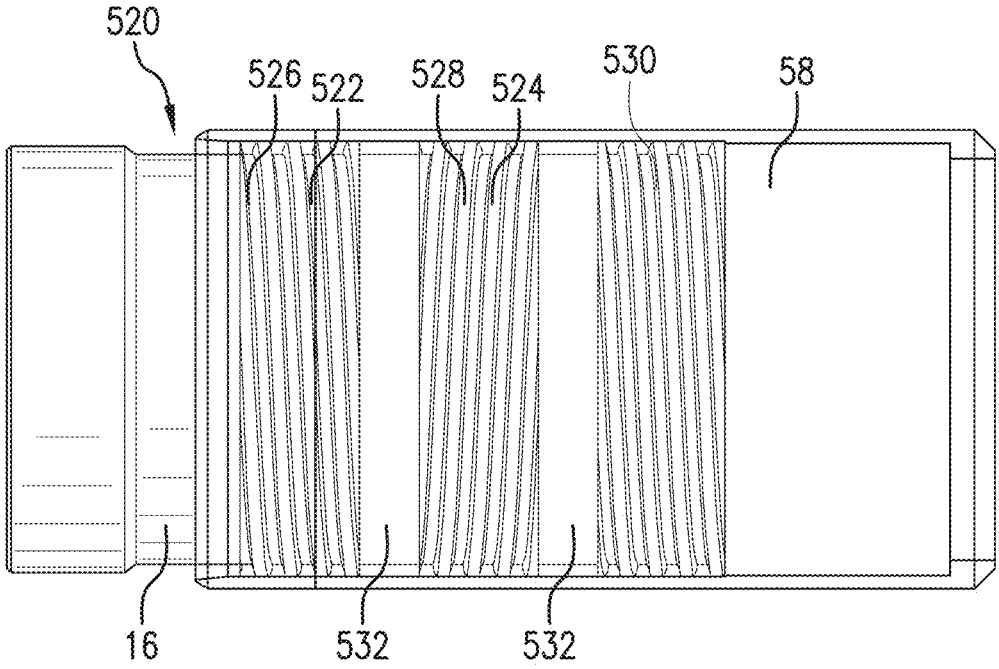
FIG. 19 depicts a schematic side view of another embodiment of a flow device for the ICD of FIG. 1.
Figure 20:
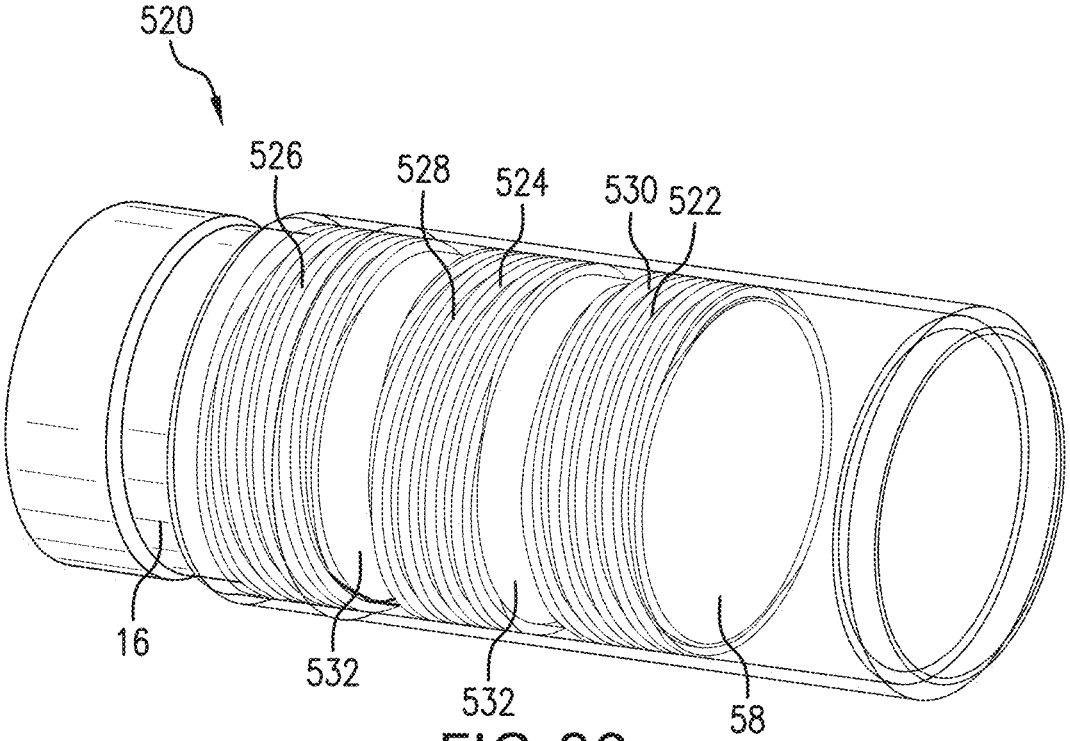
FIG. 20 depicts a schematic perspective view of the flow device of FIG. 19.

FIGS. 19 and 20 show yet another embodiment of a flow device 520 for the ICD 10. The flow device 520 includes a plurality of alternating thread helices 522 that form helical flow paths 524 between the base pipe 16 and housing 58 of the ICD 10. Flow from the inlet 34 of the flow device 520 will enter a first helical flow path 526 that is either right-handed or left-handed, and will subsequently enter a second helical flow path 528 that is either left-handed or right-handed and the opposite direction of the first helical flow path 526. A third helical flow path 530 may be additionally provided that has the same flow path direction as the first helical flow path 526 and the opposite flow path direction as the second helical flow path 528. This pattern may be continued with additional helices 522 and their corresponding helical flow paths 524. The helices 522 may be further longitudinally spaced from each other by non-helical flow areas 538. The flow exits the first helical flow path 528, enters the non-helical flow area 532, and reverses in direction to enter the second helical flow path 530. The flow reversal will cause regions of vaporization that will choke the flow.

Figure 21:
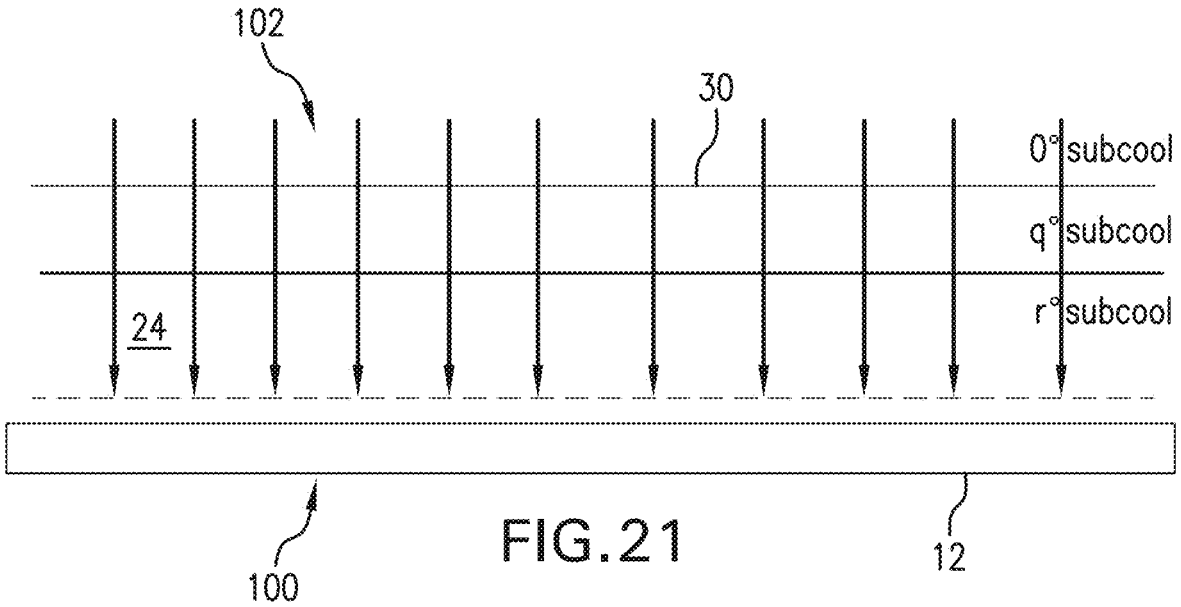
FIG. 21 depicts a schematic view of a well under ideal conditions.
Figure 22:
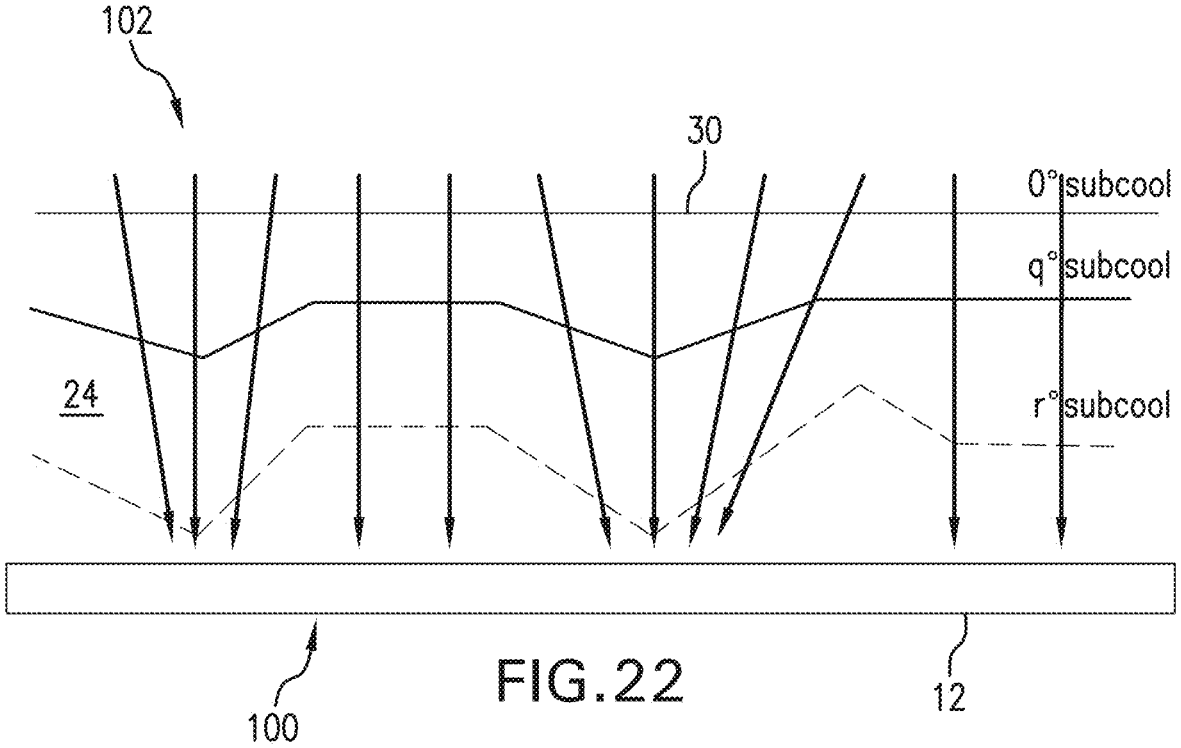
FIG. 22 depicts a schematic view of a well under normal conditions.

While some embodiments of flow devices for the ICD 10 have been particularly described, it should be understood that any features of the above-described embodiments of the flow device for the ICD 10 may be combined to form yet additional alternative embodiments. Further, a feature, which is configured to reduce a mass flow rate of liquids to the outlet (the liquids having a subcool less than a predetermined subcool for a selected drawdown pressure) lower than a mass flow rate of liquids having a subcool greater than the predetermined subcool at the selected drawdown pressure, may include any one or more the above-described nozzles, baffle, pins, flow separators, and alternating helical flow paths. The ICD 10 having one or more of the flow devices described herein are usable in the tubular system 100. Further, when the tubular system 100 is used in the SAGD system 102, the thermal gradient within the formation 24 can be controlled to distribute heat more uniformly within the formation 24 between the injection well 30 and the production tubular 12. With reference now to FIG. 21, an ideal situation is schematically depicted where the injection well 30 is at zero degrees subcool, the temperature within the formation 24 is at q degrees subcool (greater than zero) at a first distance from the injection well 30 for a selected span of the production tubular 12, and r degrees subcool (greater than q degrees subcool) along the entire span of the production tubular 12. In other words, the temperature of the fluid traveling from the injection well 30 to the production tubular 12 decreases in temperature gradually relative to the distance from the injection well 30, and the ICDs 10 of the tubular system 100 operate at the same degrees subcool for the span of the production tubular 12. However, in some formations 24, the steam from the injection well 30 and the heat from the steam do not dissipate evenly with increasing distances from the injection well 30. The formation 24 may be at q degrees subcool and r degrees subcool at varying distances from the injection well 30, such that the temperature at the production tubular 12 may be variable. If the subcool at the production tubular is variable but still at a subcool greater than a predetermined subcool for a particular drawdown pressure, then the fluids will enter as liquids and not cavitate or flash even if the temperature at the inlet is variable. However, once the temperature at the inlet is less than the predetermined subcool for a particular drawdown pressure, the ICD 10 experiencing the greater temperature will begin to cavitate and choke back production from that ICD 10, reducing production from the choked ICD 10. The heat from the heated fluids that are not being produced as quickly from the choked ICD 10 will begin to transfer to adjacent zones which are cooler (have a greater subcool) and are not being choked. This heat transfer results in a more even distribution of heat in the formation 24. In other words, the temperature at the tubular system 100 in the SAGD system 102 will look more like the ideal well shown in FIG. 21 than the conventional well shown in FIG. 22, resulting in a more even distribution of production which takes into account subcool for controlling the thermal gradient of the formation 24.

The SAGD system 102 described herein may prevent flashing steam into the tubular system 100. This is unlike a conventional system, where a subcool level may get so low that the pump pressure may end up flashing steam into the production well. Since the vapor phase (steam) does not carry oil up to the surface, and since the ESP 32 is limited in how much steam can be handled, it is advantageous to reduce steam production into a production well. In the conventional system, however, the only solution would be to reduce the pump rate, however pump rate reduction reduces flow rate from all devices. Thus, the SAGD system 102 chokes back the flow when the fluid at inlet of the ICD 10 is at a subcool level less than a predetermined subcool level. Subcool control starts to reduce mass flow rate while the section/zone is producing liquid, as opposed to just addressing the heat issue in the section/zone when the flow is already saturated, therefore fluid going through the ICD 10 is still oil-bearing liquid emulsion. Even if the fluid flashes within the ICD 10, the fluid exiting the ICD 10 will be liquid. Also, subcool control regulates thermal conformance in the formation 24 before steam breakthrough. This advantageously spreads heat to other sections/zones of the formation 24 more evenly.

Set forth below are some embodiments of the foregoing disclosure:

Embodiment 1

An inflow control device including a flow device including: an inlet; an outlet; a flow path fluidically connecting the inlet to the outlet; and a feature configured to reduce a mass flow rate of liquids to the outlet, the liquids having a subcool less than a predetermined subcool for a selected drawdown pressure, lower than a mass flow rate of liquids having a subcool greater than the predetermined subcool at the selected drawdown pressure.

Embodiment 2

The inflow control device as in any prior embodiment or combination of embodiments, wherein the feature is configured to cavitate and/or flash the liquids passing through the flow path having a subcool less than the predetermined subcool.

Embodiment 3

The inflow control device as in any prior embodiment or combination of embodiments, wherein the fluid flow path includes a nozzle, a converging portion of the nozzle configured to accelerate flow of fluids, and the feature includes a throat portion of the nozzle, a cavitating region formed at the throat portion when the liquids having a subcool less than the predetermined subcool flow through the throat portion at the selected drawdown pressure.

Embodiment 4

The inflow control device as in any prior embodiment or combination of embodiments, further including a recirculation area of the fluid flow path downstream of the nozzle and the outlet.

Embodiment 5

The inflow control device as in any prior embodiment or combination of embodiments, further including a recirculation area of the fluid flow path, and a baffle disposed in the recirculation area, wherein the baffle creates a tortuous path within the fluid flow path.

Embodiment 6

The inflow control device as in any prior embodiment or combination of embodiments, wherein the feature additionally includes an edge of the baffle, a cavitating region formed in the tortuous path at the edge of the baffle when the liquids having a subcool less than the predetermined subcool flow through the recirculation area at the selected drawdown pressure.

Embodiment 7

The inflow control device as in any prior embodiment or combination of embodiments, further including a channel connecting the nozzle to the outlet, the feature additionally including an intersecting area between the tortuous path and the channel, a cavitating region formed in the channel at the intersecting area when the liquids having a subcool less than the predetermined subcool flow through the intersecting area at the selected drawdown pressure.

Embodiment 8

The inflow control device as in any prior embodiment or combination of embodiments, wherein the nozzle has a centerline, and the outlet is spaced from the centerline.

Embodiment 9

The inflow control device as in any prior embodiment or combination of embodiments, wherein the feature includes a baffle.

Embodiment 10

The inflow control device as in any prior embodiment or combination of embodiments, wherein the baffle includes a plurality of staggered pins.

Embodiment 11

The inflow control device as in any prior embodiment or combination of embodiments, wherein the baffle includes a plurality of circumferentially distributed flow separators.

Embodiment 12

The inflow control device as in any prior embodiment or combination of embodiments, wherein the baffle creates a tortuous flow path within the fluid flow path.

Embodiment 13

The inflow control device as in any prior embodiment or combination of embodiments, wherein the feature includes helices with alternating left-handed and right-handed helical flow paths.

Embodiment 14

The inflow control device as in any prior embodiment or combination of embodiments, wherein adjacent helices are separated by a non-helical flow area.

Embodiment 15

The inflow control device as in any prior embodiment or combination of embodiments, further including a first body portion and a second body portion forming the fluid flow path and forming a nozzle therebetween, wherein the first body portion is disposed between the outlet and the nozzle.

Embodiment 16

The inflow control device as in any prior embodiment or combination of embodiments, wherein the outlet is a first outlet, and further including a second outlet, the second body portion disposed between the second outlet and the nozzle.

Embodiment 17

The inflow control device as in any prior embodiment or combination of embodiments, wherein the first body portion and the second body portion include a first end surface and a second end surface, respectively, each of the first end surface and the second end surface extending divergently from the nozzle, the outlet is disposed adjacent the first end surface, and the flow device is configured to pass fluid flow through the nozzle in a liquid phase substantially directly to the outlet and fluid flow through the nozzle in a gas phase to a recirculation area prior to being directed to the outlet.

Embodiment 18

The inflow control device as in any prior embodiment or combination of embodiments, wherein the inlet is configured to be in fluid communication with a first pressure source and the outlet is configured to be in fluid communication with a second pressure source having a lower pressure than the first pressure source, the inflow control device further including a screen in fluid communication with the inlet, and a base pipe disposed radially interiorly of the flow device, the outlet in fluid communication with the base pipe, the flow device at least partially wrapped around the base pipe.

Embodiment 19

A steam assisted gravity drainage system including: a tubular system including a plurality of the inflow control devices as in any prior embodiment or combination of embodiments, spaced longitudinally with respect to the tubular system.

Embodiment 20

The steam assisted gravity drainage system as in any prior embodiment or combination of embodiments, wherein the tubular system is a first tubular system, and further including a second tubular system configured to deliver steam to a formation and an electrical submersible pump disposed uphole of the plurality of the inflow control devices.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An inflow control device comprising a flow device including:

an inlet;

an outlet;

a flow path fluidically connecting the inlet to the outlet; and a feature configured to reduce a mass flow rate of liquids to the outlet, the liquids having a subcool less than a predetermined sub cool for a selected drawdown pressure, lower than a mass flow rate of liquids having a subcool greater than the predetermined subcool at the selected drawdown pressure.

2. The inflow control device of claim 1, wherein the feature is configured to cavitate and/or flash the liquids passing through the flow path having a subcool less than the predetermined subcool.

3. The inflow control device of claim 1, wherein the fluid flow path includes a nozzle, a converging portion of the nozzle configured to accelerate flow of fluids, and the feature includes a throat portion of the nozzle, a cavitating region formed at the throat portion when the liquids having a subcool less than the predetermined subcool flow through the throat portion at the selected drawdown pressure.

4. The inflow control device of claim 3, further comprising a recirculation area of the fluid flow path downstream of the nozzle and the outlet.

5. The inflow control device of claim 3, further comprising a recirculation area of the fluid flow path, and a baffle disposed in the recirculation area, wherein the baffle creates a tortuous path within the fluid flow path.

6. The inflow control device of claim 5, wherein the feature additionally includes an edge of the baffle, a cavitating region formed in the tortuous path at the edge of the baffle when the liquids having a subcool less than the predetermined subcool flow through the recirculation area at the selected drawdown pressure.

7. The inflow control device of claim 5, further comprising a channel connecting the nozzle to the outlet, the feature additionally including an intersecting area between the tortuous path and the channel, a cavitating region formed in the channel at the intersecting area when the liquids having a subcool less than the predetermined subcool flow through the intersecting area at the selected drawdown pressure.

8. The inflow control device of claim 3, wherein the nozzle has a centerline, and the outlet is spaced from the centerline.

9. The inflow control device of claim 1, wherein the feature includes a baffle.

10. The inflow control device of claim 9, wherein the baffle includes a plurality of staggered pins.

11. The inflow control device of claim 9, wherein the baffle includes a plurality of circumferentially distributed flow separators.

12. The inflow control device of claim 9, wherein the baffle creates a tortuous flow path within the fluid flow path.

13. The inflow control device of claim 1, wherein the feature includes helices with alternating left-handed and right-handed helical flow paths.

14. The inflow control device of claim 13, wherein adjacent helices are separated by a non-helical flow area.

15. The inflow control device of claim 1, further comprising a first body portion and a second body portion forming the fluid flow path and forming a nozzle therebetween, wherein the first body portion is disposed between the outlet and the nozzle.

16. The inflow control device of claim 15, wherein the outlet is a first outlet, and further comprising a second outlet, the second body portion disposed between the second outlet and the nozzle.

17. The inflow control device of claim 15, wherein the first body portion and the second body portion include a first end surface and a second end surface, respectively, each of the first end surface and the second end surface extending divergently from the nozzle, the outlet is disposed adjacent the first end surface, and the flow device is configured to pass fluid flow through the nozzle in a liquid phase directly to the outlet and fluid flow through the nozzle in a gas phase to a recirculation area prior to being directed to the outlet.

18. The inflow control device of claim 1, wherein the inlet is configured to be in fluid communication with a first pressure source and the outlet is configured to be in fluid communication with a second pressure source having a lower pressure than the first pressure source, the inflow control device further comprising a screen in fluid communication with the inlet, and a base pipe disposed radially interiorly of the flow device, the outlet in fluid communication with the base pipe, the flow device at least partially wrapped around the base pipe.

19. A steam assisted gravity drainage system comprising:

a tubular system including a plurality of the inflow control devices of claim 1, spaced longitudinally with respect to the tubular system.

20. The steam assisted gravity drainage system of claim 19, wherein the tubular system is a first tubular system, and further comprising a second tubular system configured to deliver steam to a formation and an electrical submersible pump disposed uphole of the plurality of the inflow control devices.

* * * * *